US007833143B1

(12) United States Patent
Tsai

(10) Patent No.: US 7,833,143 B1
(45) **Date of Patent: *Nov. 16, 2010**

(54) SIT-UP EXERCISER

(76) Inventor: Cheng-Ta Tsai, 7F-1, No. 298, Rueiguang Rd., Neihu Dist., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/592,610

(22) Filed: Nov. 30, 2009

(51) Int. Cl.
*A63B 26/00* (2006.01)

(52) U.S. Cl. ..... 482/140; 482/92; 482/96; 482/142

(58) Field of Classification Search ..... 482/51–52, 482/99–100, 72, 92–96, 140, 148, 79, 136–139, 482/121–130, 142; D21/662; 601/134, 84
See application file for complete search history.

(56) References Cited

U.S. PATENT DOCUMENTS

| | | | | | |
|---|---|---|---|---|---|
| 2,455,548 | A | * | 12/1948 | Bell | 482/96 |
| 2,642,288 | A | * | 6/1953 | Bell | 482/96 |
| 2,924,456 | A | * | 2/1960 | Miller | 482/96 |
| 4,191,370 | A | * | 3/1980 | Meyer et al. | 482/96 |
| 4,300,760 | A | * | 11/1981 | Bobroff | 482/96 |
| 5,299,997 | A | * | 4/1994 | Chen | 482/96 |
| 5,342,269 | A | * | 8/1994 | Huang et al. | 482/95 |
| 5,356,357 | A | * | 10/1994 | Wang et al. | 482/96 |
| 5,366,428 | A | * | 11/1994 | Liao | 482/96 |
| 5,370,594 | A | * | 12/1994 | Grinblat | 482/72 |
| D356,128 | S | * | 3/1995 | Smith et al. | D21/674 |
| 5,421,795 | A | * | 6/1995 | Chen | 482/96 |
| 5,580,340 | A | * | 12/1996 | Yu | 482/96 |
| 5,586,959 | A | * | 12/1996 | Adkins et al. | 482/96 |
| 5,647,825 | A | * | 7/1997 | Adkins et al. | 482/96 |
| 5,722,917 | A | * | 3/1998 | Olschansky et al. | 482/72 |
| 6,482,133 | B1 | * | 11/2002 | Miehlich | 482/72 |
| D588,655 | S | * | 3/2009 | Utykanski | D21/697 |
| 7,530,932 | B2 | * | 5/2009 | Lofgren et al. | 482/62 |
| D596,245 | S | * | 7/2009 | Tsai | D21/674 |
| 7,594,880 | B2 | * | 9/2009 | Webber et al. | 482/96 |
| 7,621,849 | B1 | * | 11/2009 | Tsai | 482/52 |
| 7,654,940 | B2 | * | 2/2010 | Webber et al. | 482/94 |
| 7,670,269 | B2 | * | 3/2010 | Webber et al. | 482/94 |
| 2007/0037673 | A1 | * | 2/2007 | Giannelli et al. | 482/95 |
| 2007/0293377 | A1 | * | 12/2007 | Webber et al. | 482/94 |
| 2008/0214365 | A1 | * | 9/2008 | Webber et al. | 482/72 |
| 2008/0248929 | A1 | * | 10/2008 | Webber et al. | 482/96 |
| 2009/0118106 | A1 | * | 5/2009 | Leisenring et al. | 482/121 |
| 2009/0227430 | A1 | * | 9/2009 | Kashiwaya | 482/94 |
| 2009/0253558 | A1 | * | 10/2009 | Lofgren et al. | 482/51 |
| 2010/0016128 | A1 | * | 1/2010 | Webber et al. | 482/94 |
| 2010/0029445 | A1 | * | 2/2010 | Lee | 482/62 |
| 2010/0069801 | A1 | * | 3/2010 | Tsai | 601/134 |

* cited by examiner

*Primary Examiner*—Lori Baker
(74) *Attorney, Agent, or Firm*—Charles E. Baxley

(57) ABSTRACT

A sit-up exerciser has a base, a seat and a footrest assembly mounted on the base, and a linkage assembly mounted between base and the seat. The linkage assembly has a handle arm, a back arm and a linking rod connected to each other. At least one rear resilient element is connected between the seat and the back arm and at least one front resilient element is connected between the footrest assembly and the handle arm. The resilient elements assist in performing sit-ups and the back arm supports a neck and vertebral column to prevent injury and damage.

9 Claims, 6 Drawing Sheets

SIT-UP EXERCISER

BACKGROUND OF THE INVENTION

1. Field of the Invention

The present invention relates to a sit-up exerciser, especially to a sit-up exerciser for assisting sit-ups.

2. Description of the Prior Art(s)

Doing sit-ups is simple, requires little space and is commonly performed in strength training, especially training of abdominal muscles and hip flexors.

However, researches have indicated that when performing sit-ups arching of a back, buttocks and abdominal muscles are affected and vertebral column and lumbar vertebral disc are at risk of damage or injury.

To overcome the shortcomings, the present invention provides a sit-up exerciser to mitigate or obviate the aforementioned problems.

SUMMARY OF THE INVENTION

The main objective of the present invention is to provide a sit-up exerciser that has a base, a seat and a footrest assembly mounted on the base, and a linkage assembly mounted between base and the seat.

The linkage assembly has a handle arm, a back arm and a linking rod connected to each other. At least one rear resilient element is connected between the seat and the back arm and at least one front resilient element is connected between the footrest assembly and the handle arm.

The resilient elements assist in performing sit-ups and the back arm supports a neck and vertebral column to prevent injury and damage.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
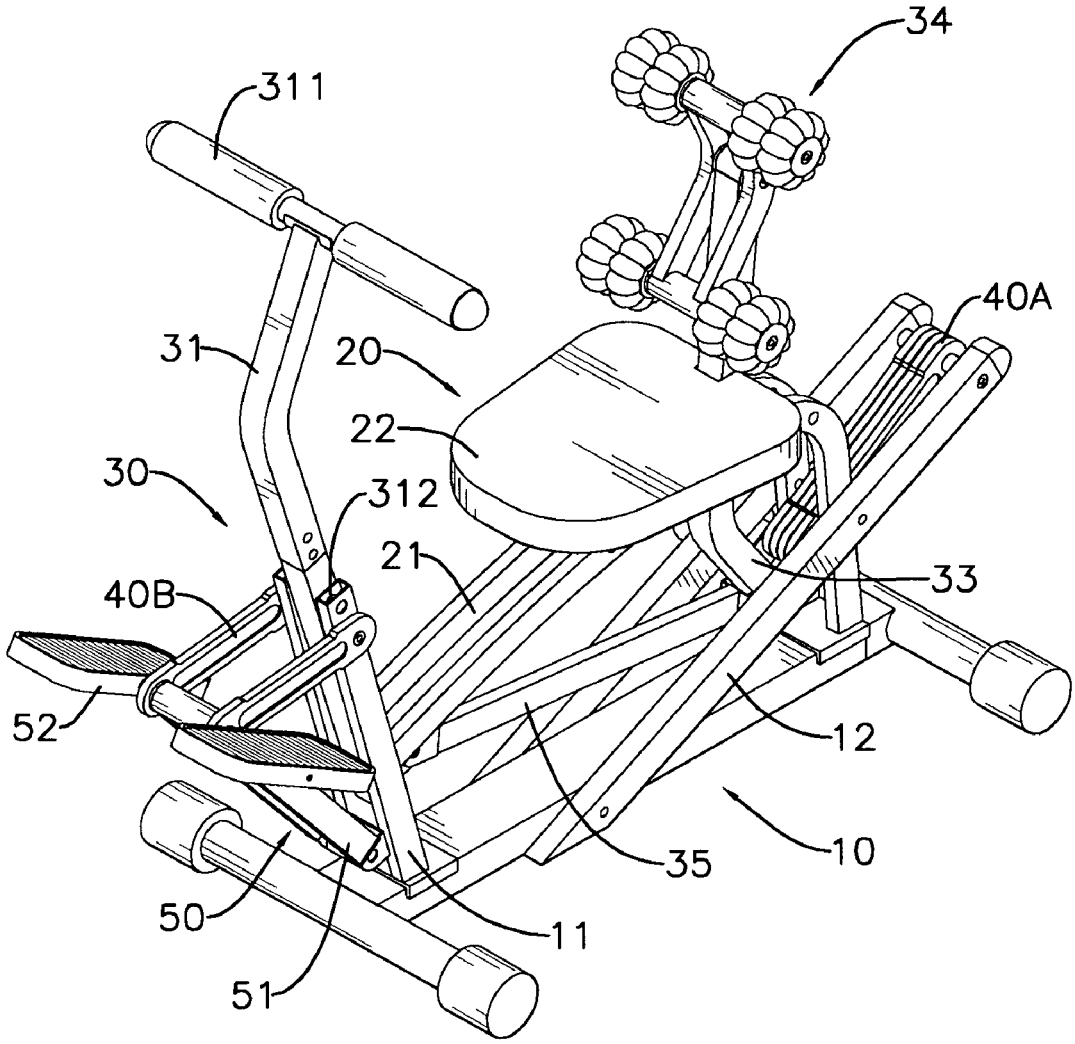
FIG. 1 is a perspective view of a sit-up exerciser in accordance with the present invention.
Figure 2:
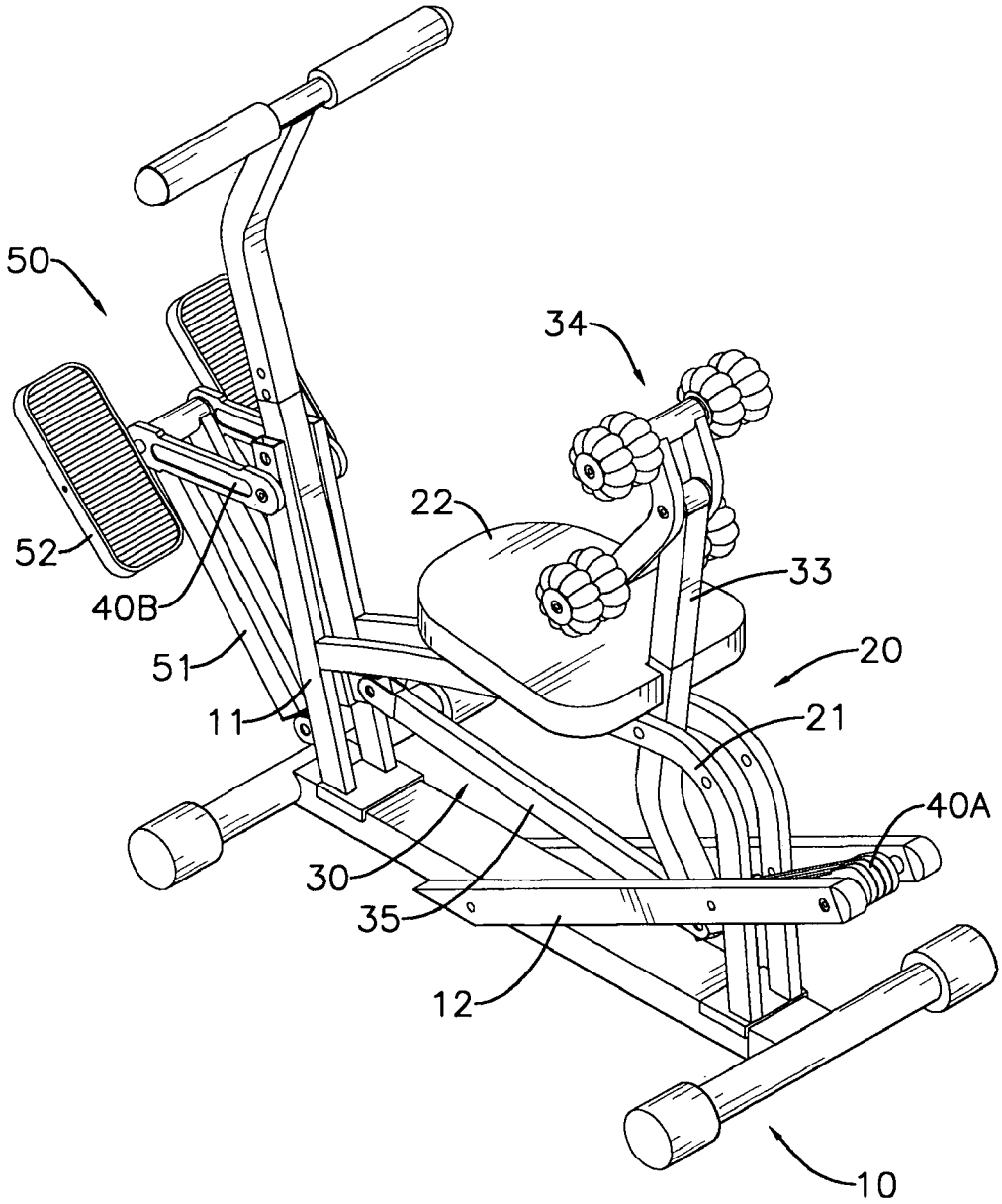
FIG. 2 is another perspective view of the sit-up exerciser in FIG. 1.

With reference to FIGS. 1 and 2, a sit-up exerciser in accordance with the present invention comprises a base (10), a seat (20), a linkage assembly (30), at least one rear resilient element (40A), a footrest assembly (50) and at least one front resilient element (40B).

Figure 6:
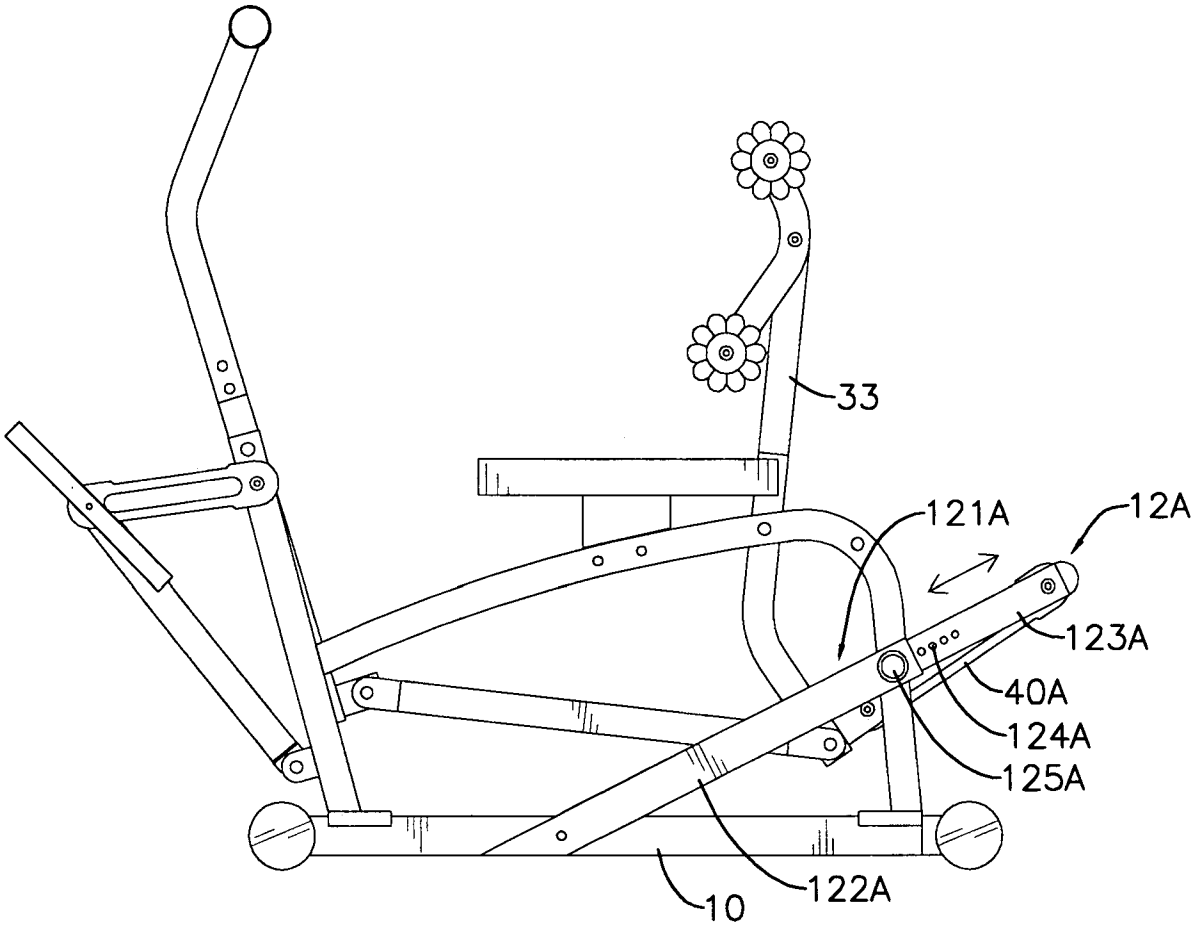
FIG. 6 is a side view of another embodiment of a sit-up exerciser in accordance with the present invention.

With further reference to FIG. 6, the base (10) is placed on a plane and has a front frame (11) and a rear frame (12, 12A). The front frame (11) obliquely protrudes up from a front end of the base (10). The rear frame (12, 12A) obliquely protrudes up from a rear end of the base (10) and may have two adjusting arms (121A). The adjusting arms (121A) are retractable. Each adjusting arm (121A) has an outer tube (122A), an inner tube (123A) and a pin (125A). The outer tube (122A) obliquely protrudes up from the rear end of the base (10). The inner tube (123A) is movably mounted in the outer tube (122A) and has multiple adjusting holes (124A). The adjusting holes (124A) are formed through the inner tube (123A). The pin (125A) is mounted through the outer tube (122A) and selectively locks in one of the adjusting holes (124A) of the inner tube (123A). Thus, lengths of the adjusting arms (121A) are adjusted.

The seat (20) is securely mounted on the base (10), is disposed between the front and rear frames (11, 12, 12A) and has a seat frame (21) and a cushion (22). The seat frame (21) is securely mounted on the base (10). The cushion (22) is disposed on the seat frame (21).

Figure 3:
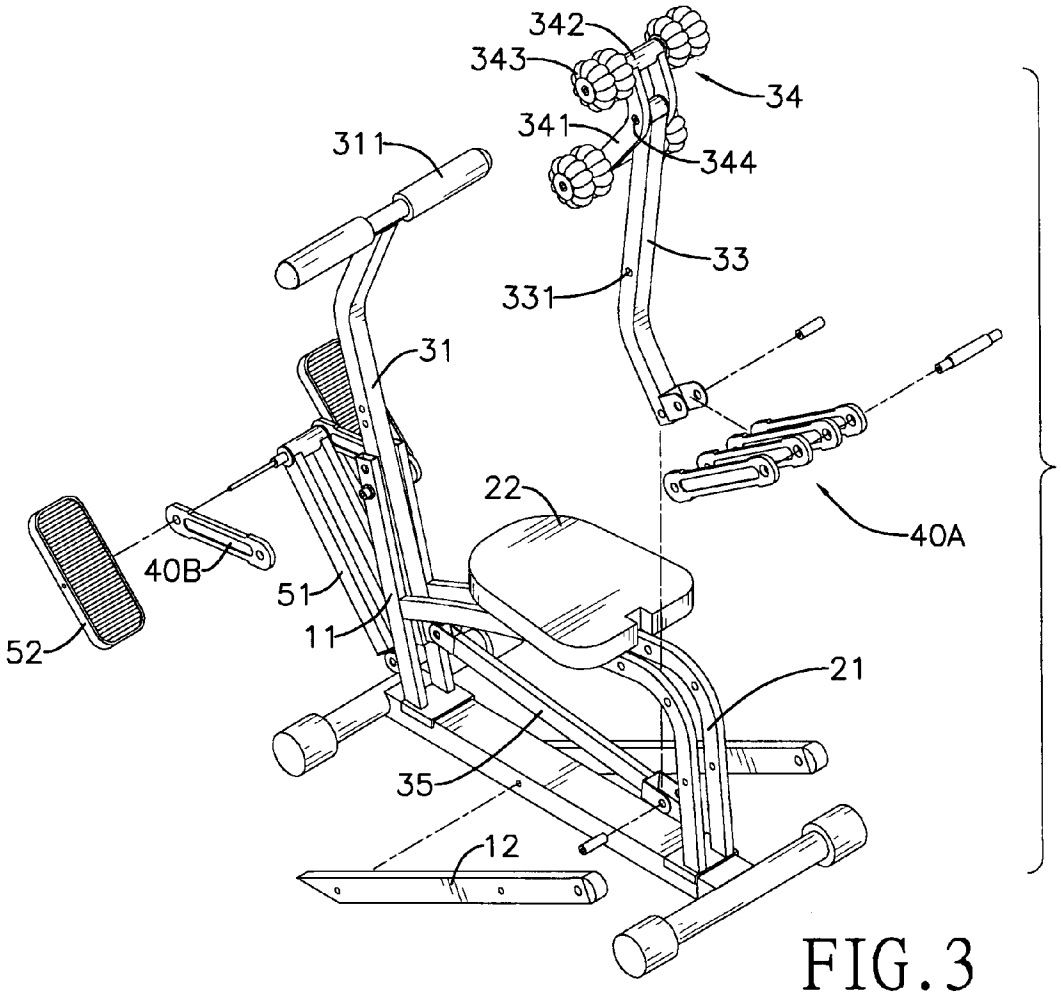
FIG. 3 is an exploded perspective view of the sit-up exerciser in FIG. 1.

With further reference to FIG. 3, the linkage assembly (30) is mounted between the base (10) and the seat (20) and has a handle arm (31), a back arm (33), a massage roller device (34) and a linking rod (35).

The handle arm (31) is rotatably mounted on the base (10) adjacent to the front end of the base (10), is mounted on the front frame (11) and has a pivot (312) and a handle bar (311). The pivot (312) of the handle arm (31) is defined adjacent to a middle of the handle arm (31), is connected to the base (10) and is connected to the front frame (11) so the handle arm (31) rotates relative to the front frame (11). The handle bar (311) is attached to an upper end of the handle arm (31).

The back arm (33) is rotatably mounted on the seat (20) adjacent to the rear end of the base (10), is mounted on the seat frame (21) of the seat (20), is disposed between the cushion (22) and the rear end of the base (10) and has a pivot (331). The pivot (331) of the back arm (33) is defined adjacent to a middle of the back arm (33), is connected to the base (10) and is connected to the seat frame (21) so the back arm (33) rotates relative to the seat frame (21).

The massage roller device (34) is mounted on the back arm (33) and has a mounting bracket (341), two mounting bars (342) and multiple rollers (343). The mounting bracket (341) is arced, is rotatably mounted on an upper end of the back arm (33) and has a pivot (344). The pivot (344) of the mounting bracket (341) is defined between a middle and an upper end of the mounting bracket (341) and is connected to the upper end of the back arm (33). Thus, a length between a lower end of the mounting bracket (341) and the pivot (344) of the mounting bracket (341) is longer than a length between the upper end of the mounting bracket (341) and the pivot (344) of the mounting bracket (341). The mounting bars (342) are respectively mounted through the upper and lower ends of the mounting bracket (341). The rollers (343) are rotatably mounted on the mounting bracket (341) and are respectively mounted on the mounting bars (342). The rollers (343) mounted on the lower end of the mounting bracket (341) are heavier than the rollers (343) mounted on the upper end of the mounting bracket (341). Consequently, a torque at the lower end of the mounting bracket (341) is larger than a torque at the upper end of the mounting bracket (341). The massage roller device (34) is uprightly disposed on the back arm (33).

The linking rod (35) has two ends. The ends of the linking rod (35) are respectively connected pivotally to lower ends of the handle and back arms (31, 33).

The at least one rear resilient element (40A) is connected between the back arm (33) of the linkage assembly (30) and the rear frame (12) of the base (10). Adjusting the lengths of the adjusting arms (121A) adjusts tightness of the at least one rear resilient element (40A).

The footrest assembly (50) is pivotally mounted on the base (10) and protrudes toward the front end of the base (10), is mounted on the front frame (11) and has a footrest frame (51) and two footrests (52). The footrest frame (51) is pivotally mounted on the front frame (11). The footrests (52) are respectively mounted on two opposite sides of the footrest frame (51).

The at least one front resilient element (40B) is connected between the footrest frame (51) of the footrest assembly (50) and the front frame (11) of the base (10).

Figure 4:
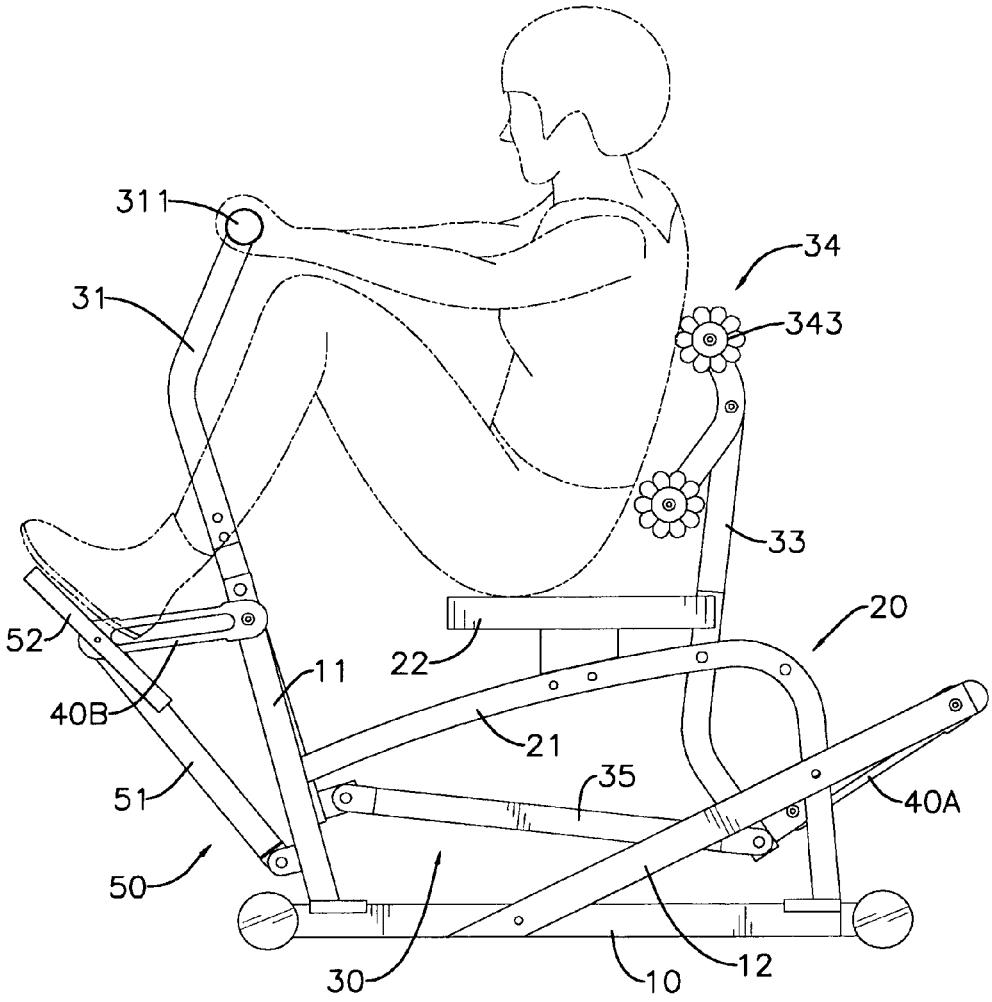
FIG. 4 is an operational side view of the sit-up exerciser in FIG. 1.
Figure 5:
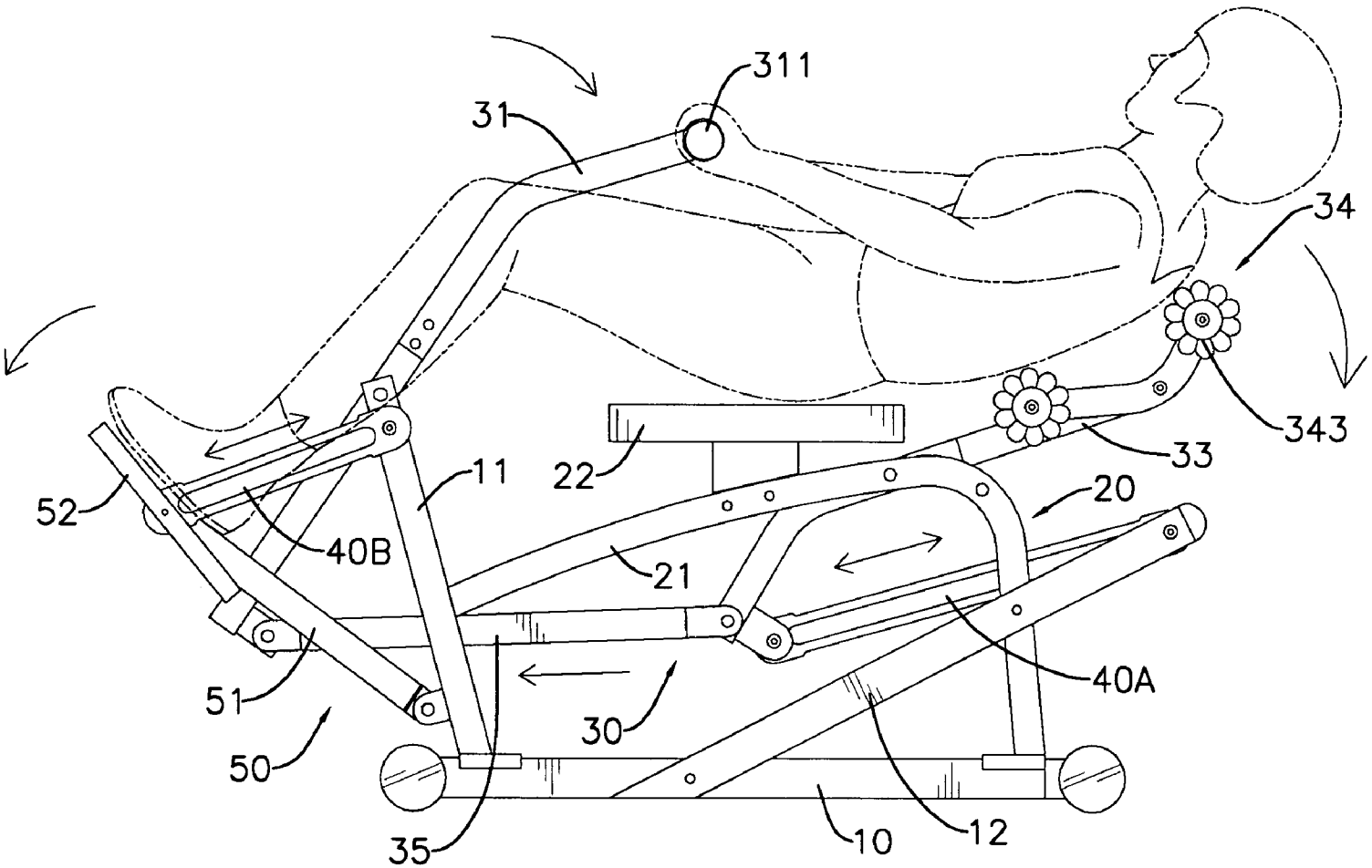
FIG. 5 is another operational side view of the sit-up exerciser in FIG. 1.

With further reference to FIG. 4, a user sit on the cushion (22) with hands holding the handle bar (311) of the handle arm (31), back leaning against the massage roller device (34) and feet placed on the footrests (52). With further reference to FIG. 5, the user pulls the handle arm (31) toward himself, presses the massage roller device (34) and the back arm (33) and the footrests (52) to straighten the footrest frame (51).

Thus, the lower end of the handle arm (31) draws the linking rod (35) so the lower end of the back arm (33) swings toward the front end of the base (10). The footrest frame (51) also swings toward the front end of the base (10). Consequently, the resilient elements (40A, 40B) are extended.

Thereafter, when the user pushes the handle frame (31) forward and tends to sit up, the at least one rear resilient element (40A) pulls the lower end of the back arm (33), the linking rod (35) and the lower end of the handle arm (31) toward the rear end of the base (10) and the at least one front resilient element (40B) pulls the footrest frame (51) toward the front frame (11). Thus, the upper end of the back arm (33), the massage roller device (34) and the upper end of the handle arm (31) swing forward to assist the user to sit up and perform a sit-up exercise. Therefore, a neck and a vertebral column of the user are supported by the back arm (33) so are not damaged. Furthermore, the rollers (343) move back and forth along the back of the user to massage and relax the user.

Moreover, while pulling the handle frame (31) and pressing the footrest frame (51), hand and foot muscles of the user are also trained. Therefore, changing the number of the resilient elements (40A, 40B) adjusts an exercise intensity of the sit-up exerciser.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sit-up exerciser comprising a base;

a seat securely mounted on the base;

a linkage assembly mounted between the base and the seat and having a handle arm rotatably mounted on the base adjacent to a front end of the base and having a pivot defined adjacent to a middle of the handle arm and connected to the base;

a back arm rotatably mounted on the seat adjacent to a rear end of the base and having a pivot defined adjacent to a middle of the back arm and connected to the base;

a massage roller device mounted on the back arm and having a mounting bracket rotatably mounted on an upper end of the back arm; and multiple rollers rotatably mounted on the mounting bracket; and a linking rod having two ends respectively connected pivotally to lower ends of the handle and back arms;

at least one rear resilient element connected between the linkage assembly and the rear end of the base;

a footrest assembly pivotally mounted on the base and protruding toward the front end of the base; and at least one front resilient element connected between the footrest assembly and the base.

2. The sit-up exerciser as claimed in claim 1, wherein the base further has a front frame obliquely protruding up from the front end of the base; and a rear frame obliquely protruding up from the rear end of the base;

the seat is disposed between the front and rear frames;

the handle arm and the footrest assembly are mounted on the front frame;

the at least one rear resilient element is connected between the back arm and the rear frame; and the at least one front resilient element is connected between the footrest assembly and the front frame.

3. The sit-up exerciser as claimed in claim 1, wherein the mounting bracket of the massage roller device has a pivot defined between a middle and an upper end of the mounting bracket and connected to the upper end of the back arm.

4. The sit-up exerciser as claimed in claim 2, wherein the mounting bracket of the massage roller device has a pivot defined between a middle and an upper end of the mounting bracket and connected to the upper end of the back arm.

5. The sit-up exerciser as claimed in claim 3, wherein the massage roller device further has two mounting bars respectively mounted through the upper and lower ends of the mounting bracket;

the rollers of the massage roller device are respectively mounted on the mounting bars; and the rollers mounted on the lower end of the mounting bracket are heavier than the rollers mounted on the upper end of the mounting bracket.

6. The sit-up exerciser as claimed in claim 4, wherein the massage roller device further has two mounting bars respectively mounted through the upper and lower ends of the mounting bracket;

the rollers of the massage roller device are respectively mounted on the mounting bars; and the rollers mounted on the lower end of the mounting bracket are heavier than the rollers mounted on the upper end of the mounting bracket.

7. The sit-up exerciser as claimed in claim 2, wherein the footrest assembly further has a footrest frame pivotally mounted on the front frame; and two footrests respectively mounted on two opposite sides of the footrest frame; and the at least one front resilient element is connected between the footrest frame and the front frame.

8. The sit-up exerciser as claimed in claim 7, wherein the seat further has a seat frame securely mounted on the base; and a cushion disposed on the seat frame; and the back arm of the linkage assembly is mounted on the seat frame of the seat and is disposed between the cushion and the rear end of the base;

the pivot of the back arm is connected to the seat frame; and the handle arm of the linkage assembly further has a handle bar attached to an upper end of the handle arm.

9. The sit-up exerciser as claimed in claim 2, wherein the rear frame of the base has two adjusting arms being retractable, and each adjusting arm having an outer tube obliquely protruding up from the rear end of the base;

an inner tube movably mounted in the outer tube and having multiple adjusting holes formed through the inner tube; and a pin mounted through the outer tube and selectively locking in one of the adjusting holes of the inner tube.

* * * * *